US007622662B2

(12) United States Patent
Shaper et al.

(10) Patent No.: US 7,622,662 B2
(45) Date of Patent: Nov. 24, 2009

(54) STRING PERCUSSION INSTRUMENT

(75) Inventors: Thomas O. Shaper, 170 Canyon Rd., Chagrin Falls, OH (US) 44022-2418; Robert P. Sandham, Chesterland, OH (US)

(73) Assignee: Thomas O. Shaper, Chagrin Falls, OH (US)

( * ) Notice: Subject to any disclaimer, the term of this patent is extended or adjusted under 35 U.S.C. 154(b) by 0 days.

(21) Appl. No.: 11/986,903

(22) Filed: Nov. 27, 2007

(65) Prior Publication Data

US 2008/0134860 A1 Jun. 12, 2008

Related U.S. Application Data

(60) Provisional application No. 60/874,468, filed on Dec. 11, 2006.

(51) Int. Cl.
*G10D 1/08* (2006.01)

(52) U.S. Cl. ..... 84/267; 84/293

(58) Field of Classification Search ..... 84/267, 84/293

See application file for complete search history.

(56) References Cited

U.S. PATENT DOCUMENTS

| | | | | | |
|---|---|---|---|---|---|
| 2,796,795 | A | * | 6/1957 | Bach | 84/173 |
| 3,398,622 | A | | 8/1968 | Smith | |
| 3,739,072 | A | | 6/1973 | Smith | |
| 3,833,751 | A | | 9/1974 | Chapman | |
| 4,656,917 | A | | 4/1987 | Van Halen | |
| 5,202,527 | A | | 4/1993 | Gracie | |
| 5,251,526 | A | * | 10/1993 | Hill | 84/263 |
| 5,320,019 | A | | 6/1994 | McCaw | |
| 5,841,052 | A | | 11/1998 | Stanton | |
| 5,852,249 | A | * | 12/1998 | Steinberg et al. | 84/293 |
| 5,994,633 | A | * | 11/1999 | Norton | 84/290 |
| 6,034,308 | A | * | 3/2000 | Little | 84/291 |
| 6,037,532 | A | | 3/2000 | Beckmeir | |
| 6,353,164 | B1 | * | 3/2002 | Corsi | 84/293 |
| 2006/0213351 | A1 | * | 9/2006 | Hsieh | 84/327 |
| 2008/0134860 | A1 | | 6/2008 | Shaper | |

FOREIGN PATENT DOCUMENTS

| | | | |
|---|---|---|---|
| JP | 411305762 | A | 11/1999 |

* cited by examiner

*Primary Examiner*—Kimberly R Lockett
(74) *Attorney, Agent, or Firm*—Fay Sharpe LLP; Brian E. Turung

(57) ABSTRACT

An instrument having a body, a neck and a plurality of strings connected between the body and neck. The body and neck have a top surface. The top surface of the neck is offset by some angle relative to the top surface of the body. The strings are positioned on the instrument such that the strings overlie at least a portion of the top surface of the body and the neck of the instrument.

12 Claims, 4 Drawing Sheets

STRING PERCUSSION INSTRUMENT

The present invention claims priority on U.S. Provisional Patent Application Ser. No. 60/874,468 filed Dec. 11, 2006, which is incorporated herein by reference.

The present invention relates to musical instruments, and more particularly to percussion instruments, and even more particularly to a percussion instrument that includes a plurality of strings.

BACKGROUND OF THE INVENTION

Currently, there is a demand for new sounds in the music industry. Musicians are playing music one garbage cans, bicycle parts, furniture, etc. to create a new sound and/or unique visual effect for music. Most of these new instruments are percussion instruments that are struck with a drum stick, mallet, etc. to crate the new sound. Most of these new forms of percussion instruments have a single sound range when struck. As such, the range of music that can be used with these new types of percussion instruments, as with most percussion instruments, can be limiting.

String instruments, as apposed to most percussion instruments, can play a wide variety of notes and chords. One of the more popular string instruments is a guitar. There are various types of guitars that are used by musicians. The guitar style used to compose and/or play a particular song can be dictated by the style of music and/or the chords needed to play the song. For instance, the shape and/or style of a guitar used to perform rock music is typically different from a guitar style used to perform country music, blues music, and the like. Typically each style of music requires the use of a commonly accepted guitar style and shape that the fans and musicians alike are accustomed to seeing and playing. In addition, some types of music require the guitar to have a certain number of strings (e.g., 4, 5, 6, 12, etc.) in order to properly perform the song. Furthermore, some songs require a fretless guitar to be played, thereby requiring a special guitar for this technique. The versatility of string instruments such as guitars generally results in the string instrument playing a major part in most types of music.

In view of the present state of percussion instruments, there is a need for a unique percussion instrument that has the ability to play variety of notes and chords.

SUMMARY OF THE INVENTION

The present invention is directed to percussion instruments, and more particularly to a percussion instrument that includes a plurality of strings that can be struck by one or more devices to create the sound of one or more notes and/or chords. One non-limiting unique feature of the present invention is that the front face of the body of the percussion instrument faces in an opposite direction to the front face of the neck of the percussion instrument. Another and/or alternative non-limiting embodiment of the present invention, the front face of the body includes a bridge plate and a plurality of intonation sliders. In one non-limiting aspect of this embodiment, each intonation slider is connected to one end of a string; however, this is not required. The configuration of the bridge plate, intonation sliders and strings on the front face of the percussion instrument can be the same or similar to such arrangements used on various types of acoustic guitars, electric guitars, or other types of string instruments (e.g., a balalaika, a banjo, a cello, a double bass, flamenco guitar, a lyre, a mandolin, a twelve-string acoustic guitar, a viola, a violin, etc.); however, this is not required. In still another and/or alternative non-limiting embodiment of the present invention, one or more of the strings pass through and/or under at least one cavity in the body and/or bridge on the body. The neck of the percussion instrument is generally secured to the at least one cavity in the body and/or bridge on the body; however, this is not required. The at least one cavity in the body and/or bridge on the body enables one or more strings on the percussion instrument to be positioned on both the front face of the body and the front face of the neck. Generally, the at least one cavity in the body and/or bridge on the body is designed so that one or more strings do not come in contact with the inside walls of the at least one cavity in the body and/or bridge on the body; however, this is not required. In another and/or alternative non-limiting embodiment of the present invention, a plurality of strings are positioned on the front face of the neck of the percussion instrument; however, this is not required. In one non-limiting aspect of this embodiment, positioned on the top surface of the neck is a fingerboard; however, this is not required. The fingerboard, when used, can be releasably or permanently secured to the top of the neck in a variety of manners. The fingerboard can include one or more frets; however, this is not required. The fingerboard can also include one or more fret markers or position markers along the length of the fingerboard; however, this is not required. The configuration of the neck, frets, and markers can be the same or similar to such arrangements used on various types of acoustic guitars, electric guitars, or other types of string instruments; however, this is not required. Connected to the end of the neck is a headstock. In yet another and/or alternative non-limiting embodiment of the present invention, the headstock includes one or more tuners; however, this is not required. The tuners, when used, are used to increase or decrease the tension on a particular string in order to tune a particular string. The configuration of the headstock and tuners can be the same or similar to such arrangements used on various types of acoustic guitars, electric guitars, or other types of string instruments; however, this is not required. As can be appreciated, the design of the various components of the string percussion instrument (e.g., body, neck, headstock, etc.) is non-limiting.

In one non-limiting aspect of the present invention, the design of the string percussion instrument of the present invention enables a player, when playing the instrument, to strike one or more of the strings on the front face of the body which are facing the player. The player may strike the one or more strings with his hand, fingers, etc. and/or strike the one or more strings in some other or additional manner (e.g., with a drum stick, mallet, etc.). While the one or more strings on the face of the body are facing the player, the one or more strings on the neck of the string percussion instrument face away from the player. Heretofore, it is believed that no such instrument has ever been created. This arrangement has several unique features. In one non-limiting embodiment of the present invention, the neck and string configuration on the neck can be the same or similar to configurations on a guitar or other type of string instrument; however, this is not required. This configuration enables a player that is familiar with playing a string instrument (e.g., guitar, etc.) to position his/her fingers on the neck and strings to produce notes and chords similar to ones that could be formed when play a standard string instrument. As such, the player can position his/her fingers on the strings on the neck with one hand and strike the strings facing the player on the body to create certain tones on the string percussion instrument. Since the configuration of the strings on the neck can be the same or similar to standard string instruments, a player that is already able to play a string instrument can easily finger the strings on the string percussion instrument of the present invention to create the desired sounds from the percussion instrument when the strings on the body are struck.

In another and/or alternative non-limiting aspect of the present invention, the string percussion instrument can include one or more mounts to enable the body and/or another portion of the string percussion instrument to be mounted on a device so as to facilitate in the playing of the instrument; however, this is not required. The mounting arrangement can include a variety of mounting systems (e.g., clamp, bolt, screw, Velcro, etc.). The mounting arrangement can be a quick release mounting arrangement; however, this is not required.

In still another and/or alternative non-limiting aspect of the present invention, the body of the percussion string instrument can include one or more electronic components; however, this is not required. Such electronic components, when used, can include, but are not limited to, volume controls, tone controls, special effect controls, output jacks, electrical connectors, pickups, etc.; however, this is not required. In one non-limiting embodiment of the present invention, the body of the string percussion instrument can include at least one storage area; however, this is not required. The storage area, when used, can be used to store one or more graphic clips that are attachable to the guitar, picks, capos, etc.

In yet another and/or alternative non-limiting aspect of the present invention, the body of the string percussion instrument can include one or more interchangeable pickups; however, this is not required. The interchangeability of one or more pickups, when used, allows the player to customize the instrument for a particular style or use. The pickups can be used to facilitate in setting the range of sound of the guitar when played; however, this is not required. When the range of sound is needed or desired to be changed, the number of pickups can be selected and/or the orientation of one or more pickups can be selected on the instrument; however, this is not required.

In still yet another and/or alternative non-limiting aspect of the present invention, the string percussion instrument includes a body, a neck, and a headstock; however, this is not required. In one non-limiting embodiment of the present invention, the string percussion instrument in the fully assembled form has the general appearance of a modified guitar with the neck rotated at least about 10° relative to the body, generally at least about 30° relative to the body, typically at least about 60°-90° relative to the body, more typically over 90° relative to the body, even more typically at least about 120° relative to the body, still even more typically at least about 150° relative to the body, and yet still even more typically at least about 180° relative to the body. As can be appreciated, the configuration of the body, neck and headstock is non-limiting.

In another and/or alternative non-limiting aspect of the present invention, the body of the string percussion instrument can be made from a variety of materials such as, but not limited to, metals, plastics, woods, composite materials, fiber materials, ceramics, glass, etc. In one non-limiting embodiment of the invention, the body is formed from or includes one or more pieces of wood; however, this is not required. In another and/or alternative non-limiting embodiment of the present invention, the upper surface of the body can include a variety of finishes and/or designs to obtain a desired look for the instrument; however, this is not required. In still another and/or alternative non-limiting embodiment of the present invention, the upper surface of the body can include a pick guard to protect one or more surfaces of the shell body; however, this is not required. The shape of the body can be any one of a number of different shapes. In yet another and/or alternative non-limiting embodiment of the present invention, the body can include an output jack which is designed to be connected to an amplifier and/or other types of audio components; however, this is not required. As can be appreciated, location of the output jack on the body, when used, is non-limiting. In yet another and/or alternative non-limiting embodiment of the present invention, the body can include one or more connectors to mount the body to a standard drum stand and/or other type of stand; however, this is not required. The configuration of the one or more connectors and/or the location of the connectors on the body, when used, are non-limiting.

In still another and/or alternative non-limiting aspect of the present invention, the body can include one or more knobs; however, this is not required. The knobs, when used, typically control the tone, volume and/or special effects of the instrument; however, it can be appreciated that the one or more knobs can be used for other features on the instrument. The knobs, when used, are typically connected to controllers; however, this is not required. An electric connector or jack, not shown, can also be positioned on the body, however, this is not required. The electrical connector or jack, when used, can be designed to electrically connect the instrument to a power source; however, this is not required. The electrical connector, when used, can be use to send and/or receive signals and/or power to various components in the instrument (e.g., amplifier, speaker, mixer, and/or other electric device, etc.); however, this is not required.

In yet another and/or alternative non-limiting aspect of the present invention, the front of the body has a front lip that is designed to be connected to the neck of the instrument; however, this is not required. In one non-limiting embodiment of the invention, the top face of the body can include a bridge mounting plate; however, this is not required. In another and/or alternative non-limiting embodiment of the invention, the top face of the body can include a pickup box that is designed to be inserted into a pickup box cavity of main body; however, this is not required. The pickup box, when used, can include a plurality of slots that are designed to receive pickups. The bottom of the pickup box, when used, can include an electrical connector, which can be designed to connect to an electrical connector in the pickup box cavity of the body; however, this is not required. The electrical connector, when used, can be used to allow for signals and/or power to be sent to and/or from one or more pickups on the pickup box; however, this is not required. The pickup box, when used, can be secured in the pickup cavity in a variety of ways. As can be appreciated, the pickup box can be permanently or releasably secured in the body by various arrangements. The pickup box configuration is non-limiting, thus can be any number of configurations to obtain the desired pickup configuration on the body of the instrument and/or sound and/or tonal quality for the instrument.

In still yet another and/or alternative non-limiting aspect of the present invention, the face or top surface of the neck of the string percussion instrument typically includes a fingerboard; however, this is not required. The fingerboard, when used, can be releasably or permanently secured to the top face of the neck in a variety of manners. In one non-limiting embodiment of the present invention, the fingerboard, when used, can include one or more frets; however, this is not required. In another one non-limiting embodiment of the present invention, the fingerboard can also include several fret markers or position markers along the length of the fingerboard; however, this is not required. In still another and/or alternative non-limiting embodiment of the invention, the face or top surface of the neck can face in the opposite direction from the face or top surface of the body of the string percussion instrument; however, this is not required. As can be appreciated, the face or top surface of the neck can be oriented relative to the face or top surface of the body of the string percussion instrument in other ways so long as the face or top surface of the neck and the face or top surface of the body of the string percussion instrument do not face in the same direction and/or lie in the same plane. In one non-limiting aspect of this embodiment, the face or top surface of the neck is offset by at least about 90° from the face or top surface of the body of the string percussion instrument.

In another and/or alternative non-limiting aspect of the present invention, the string orientation of the instrument can be such that the strings lie in a generally concave plane relative to the face or top surface of the neck, and also lie in a generally convex plane relative to the face or top surface of the body; however, this is not required. The generally concave plane orientation of the strings on the neck, when used, is similar to the standard orientation of strings positioned on standard string instruments (e.g., guitar, etc.); however, this is not required. As such, during the playing of the string percussion instrument of the present invention, the feel and orientation of the fingers of the player on the neck of the instrument closely emulates the play on a standard string instrument, thereby facilitating the play of the string percussion instrument; however, this is not required. The convex orientation of the strings on the face or top surface of the body, when used, can be an opposite string orientation on standard string instruments; however, this is not required. On standard string instruments, the strings are in a generally concave plane over both the neck and body of the string instrument. The convex orientation of the strings on the body of the string percussion instrument of the present instrument can enable a plurality or all of the strings to be simultaneously struck when using a standard drum stick or the like. This cannot be accomplished on standard string instruments due to the concave orientation of the strings.

In still another and/or alternative non-limiting aspect of the present invention, a headstock can be connected to the rear end of the neck; however, this is not required. The headstock, when used, can include several tuner openings which are designed to receive pins of tuners; however, this is not required. The pins of the tuners, when used, can be designed to be each connected to a string on the string percussion instrument. The pegs on the tuners can be designed to cause the pins to rotate, thereby increasing or decreasing the tension on a particular string in order to tune a particular string; however, this is not required.

One non-limiting object of the present invention is to provide a novel string instrument.

Another and/or alternative non-limiting object of the present invention is to provide a novel string instrument wherein the front face of the body of the string instrument faces in a different direction from the front face of the neck of the string instrument.

Still another and/or alternative non-limiting object of the present invention is to provide a novel string instrument wherein the configuration of the neck, frets, markers and/or tuners of the string instrument can be the same or similar to other types of standard string instruments.

Yet another and/or alternative non-limiting object of the present invention is to provide a novel string instrument that enables a player to strike one or more of the strings on the front face of the body that are facing the player while one or more strings on the neck of the string percussion instrument face at least partially away from the player.

Still yet another and/or alternative non-limiting object of the present invention is to provide a novel string instrument wherein one or more strings lie in a generally concave plane relative to the face or top surface of the neck and one or more strings lie in a generally convex plane relative to the face or top surface of the body of the string instrument.

These and other objects and advantages will become apparent to those skilled in the art upon reading and following the description taken together with the accompanying drawings.

BRIEF DESCRIPTION OF THE DRAWINGS

Reference may now be made to the drawings which illustrate various preferred embodiments that the invention may take in physical form and in certain parts and arrangement of parts wherein.

DETAILED DESCRIPTION OF THE PREFERRED EMBODIMENTS

Figure 1:
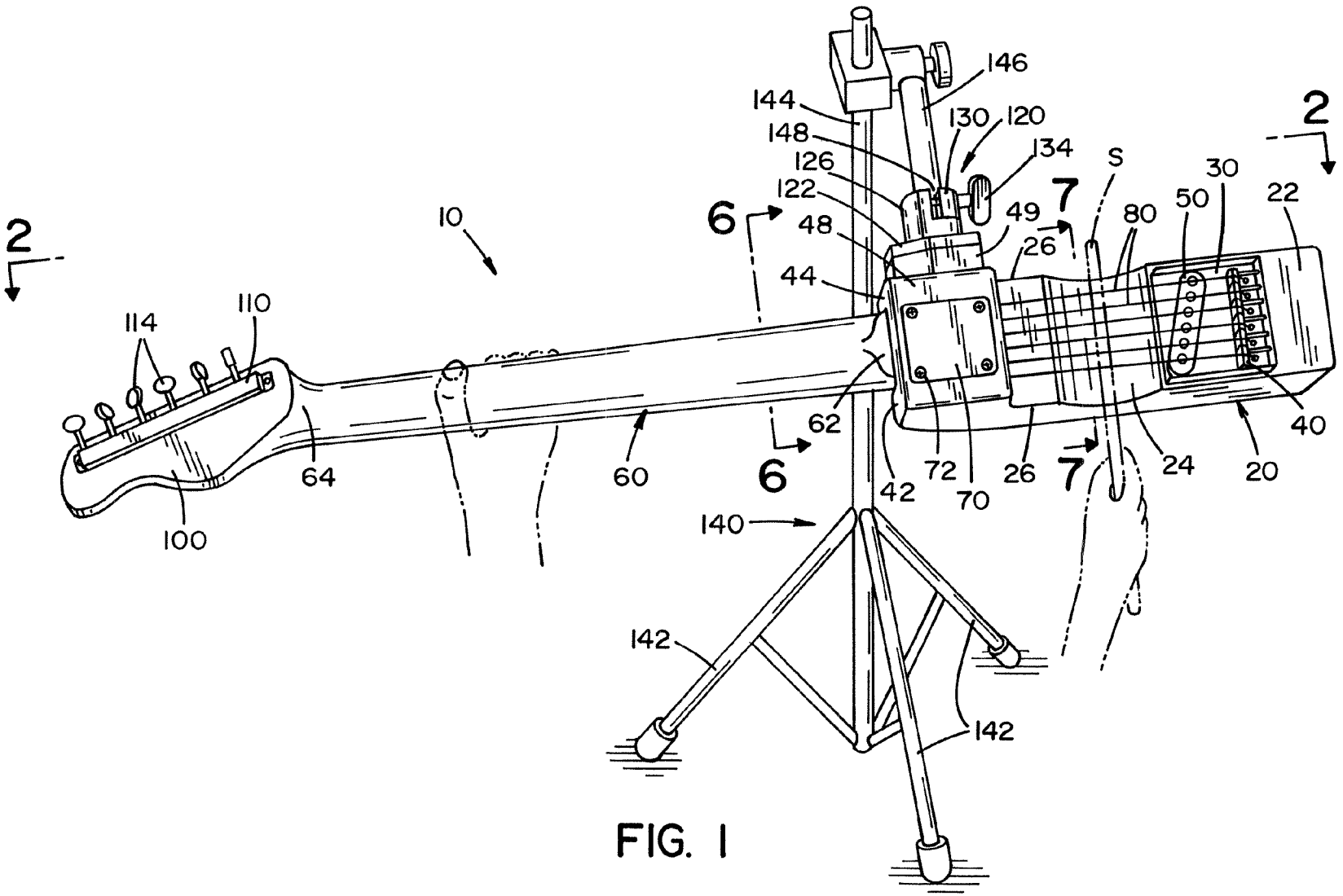
FIG. 1 is front elevation view of the string instrument in accordance with the preset invention.

Referring now to the drawings wherein the showings are for the purpose of illustrating preferred embodiments of the invention only and not for the purpose of limiting same, FIG. 1 illustrates one non-limiting string or percussion instrument 10 in accordance with the present invention.

Figure 3:
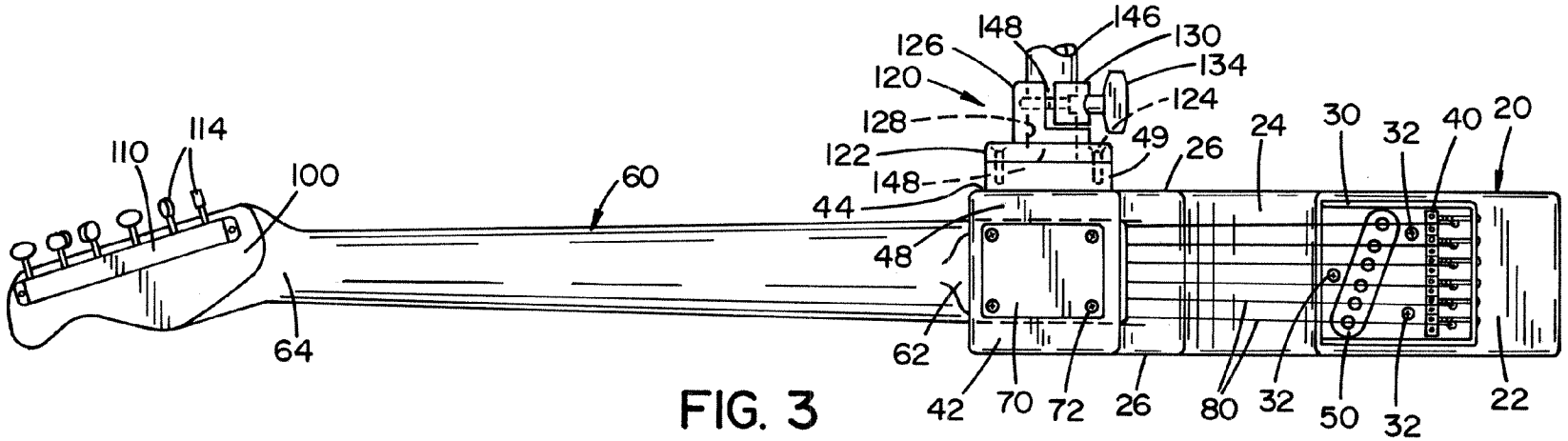
FIG. 3 is a top view of the string instrument of FIG. 1.

The instrument 10 includes a body 20, a neck 60 and a plurality of strings 80 connected between the body and neck. The plurality of strings are designed to be struck by the hands of a user and/or by one or more devices to create the sound of one or more notes and/or chords. The front face 22 of the body 20 includes a bridge plate 30 and a plurality of intonation sliders 40. Each intonation slider is connected to one end of a string 80. The configuration of the bridge plate, intonation sliders and strings on the front face of instrument 10 can be the same or similar to such arrangements used on various types of acoustic guitars, electric guitars, or other types of string instruments, thus the use of such components will not be further described in detail herein. The connection of the strings to the intonation sliders, the connection of the bridge plate to body 20 is known in the art, thus will not be described in detail herein. As illustrated in FIG. 3, three screws 32 are used to secure the bridge plate to the body; however, other or additional arrangements can be used. The shape, design and/or color of body 20 is non-limiting. In addition, the type of material used to form the body are non-limiting.

As illustrated in FIG. 1, the front face 22 of the body can include at least one depressed region 24 that generally defines the region below where strings 80 are typically struck; however, this is not required. As can be appreciated, body 20 can have a different sized and/or shaped depressed region, and/or have no depressed region. The depressed region 24 is illustrated as extending fully between the width of body 20; however, it can be appreciated that the depressed region can extend less than the full width of the body. Generally at least one depressed region, when used, is positioned on and extends inward from at least one side edge 26 of the body; however, this is not required. The depressed region 24 on the body 20, when used, facilitates in enabling a user to strike one or more of the strings, such as, but not limited to, a stick S as illustrated in FIG. 1.

The instrument can include one or more pickups 50; however, this is not required. The pickups, when used, can facilitate in setting the range of sound of the guitar when played; however, this is not required. When the range of sound is needed or desired to be changed, the number of pickups can be selected and/or the orientation of one or more pickups can be selected on the instrument. The body 20 of the instrument can include a pickup box 52 that is designed to be inserted into a pickup box cavity 28 of body 20. The pickup box 52, when used, can include one or more slots, not shown, that are designed to receive one or more pickups 50. The bottom of the pickup box, when used, can include an electrical connector 54, which can be designed to connect to an electrical connector in the pickup box cavity of the body. The electrical connector, when used, can be used to allow for signals and/or power to be sent to and/or from one or more pickups on the pickup box. As can be appreciated, the instrument can include one or more additional electronic components; however, this is not required. Such electronic components, when used, can include, but are not limited to, volume controls, tone controls, special effect controls, output jacks, electrical connectors, etc. As can be appreciated, electrical connector 54 can function as an output jack that is designed to be connected to an amplifier and/or other types of audio components; however, this is not required. As can be appreciated, location of connector 54 on the body, when used, is non-limiting. As can also be appreciated, the body of the instrument can include one or more knobs, not shown; however, this is not required. The knobs, when used, typically control the tone, volume and/or special effects of the instrument; however, it can be appreciated that the one or more knobs can be used for other features on the instrument. The knobs, when used, are typically connected to controllers; however, this is not required.

Figure 5:
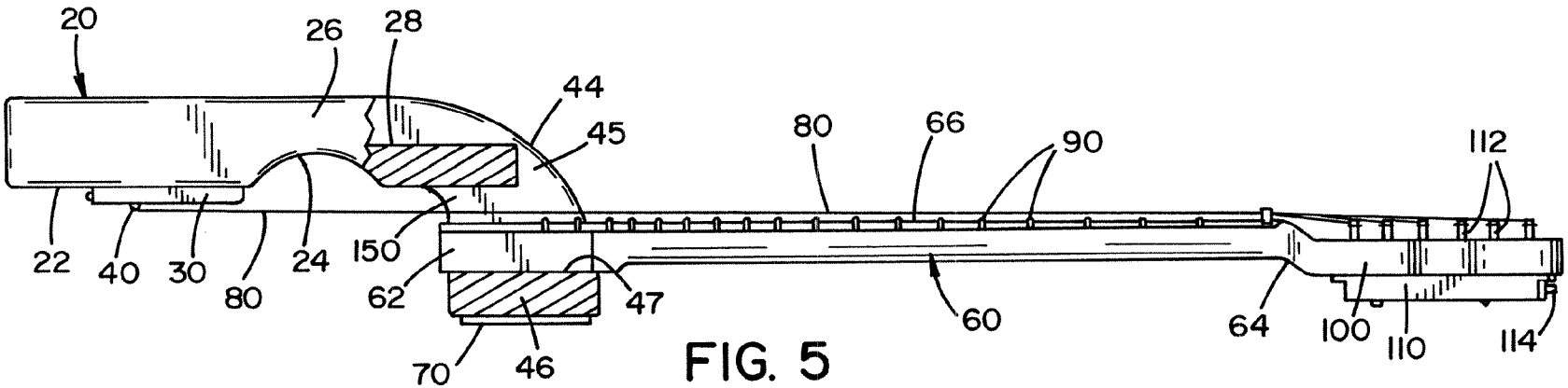
FIG. 5 is a side view of the string instrument of FIG. 1.
Figure 6:
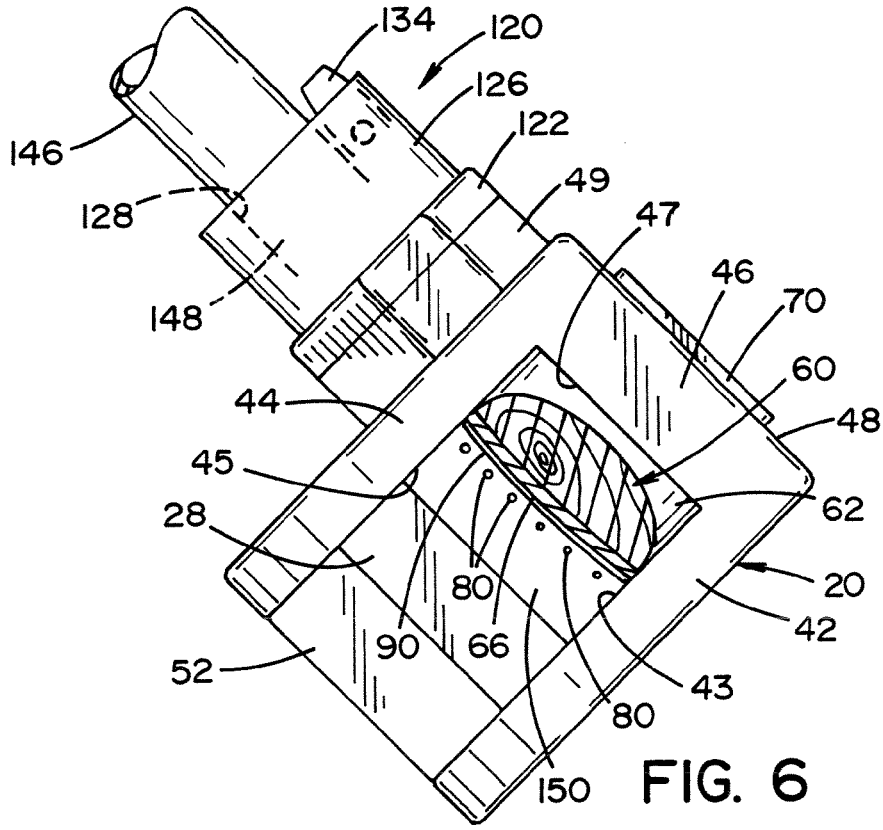
FIG. 6 is a cross-sectional view along line 6-6 of FIG. 1.
Figure 7:
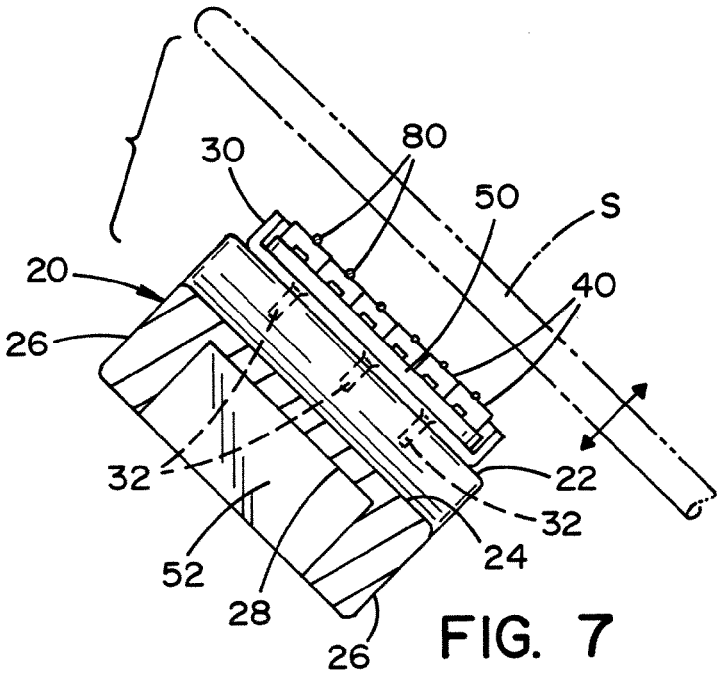
FIG. 7 is a cross-sectional view along line 7-7 of FIG. 1.

Referring now to FIGS. 2, 3, 5 and 6, body 20 includes a cavity or bridge structure 150 that enables strings 80 to pass under or through a portion of the body. As best illustrated in FIG. 6, body 20 includes two side walls 42, 44 each having an inner surface 43, 45 respectively. A cross block 46 having an inner surface 47 and outer surface 48 is connected between the two side walls. The side wall and cross block arrangement as illustrated in FIG. 6 has a generally U-shaped cross-sectional profile; however, it can be appreciated that many other shapes can be formed. Although FIG. 6 illustrates the use of at least two side walls of cavity or bridge structure 150, it will be appreciated that only one side wall can be used. For example, the use of one side wall and the cross block could form an L-shaped cross-sectional profile; however, other shapes can be formed using one side wall and the cross-block.

Figure 2:
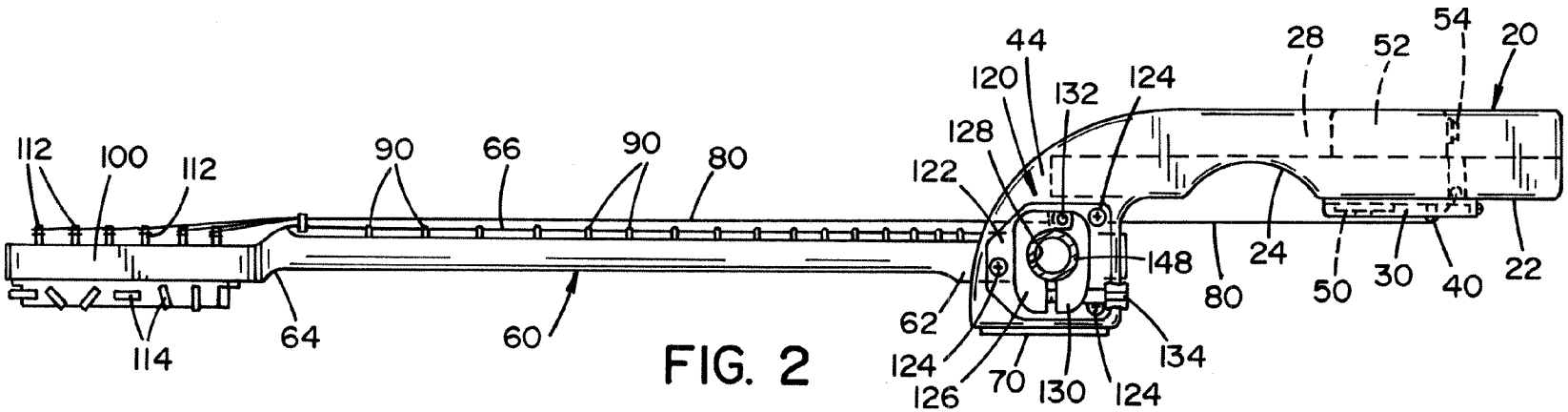
FIG. 2 is a cross-sectional view along line 2-2 of FIG. 1.

As best illustrated in FIGS. 2 and 3, strings 80 pass between side walls 42 and 44 and under cross block 46 as the strings move from the bridge plate 30 on body 20 to the back end 64 of neck 60. The inner surfaces 43, 45 of the side walls are illustrated as spaced from the strings.

The front end 62 and/or region about the front end 62 of neck 60 is connected to the cross block 46. As can be appreciated, the neck can be additional or alternatively connected to one or more of the side wall; however, this is not required. The neck can be permanently or releasably connected to body 20. As illustrated in FIGS. 1 and 6, a connection plate 70 in combination with a plurality of screws 72 are used to secure the neck to the inner surface 47 of cross block 46. The connection plate is illustrated are being positioned on the outer surface of the cross block. The use of the connection plate is optional. As can be appreciated, other or additional arrangements can be used to secure the neck to cross block 46 (e.g., adhesive, clamp, dowel, pin, bolt, etc.).

As best illustrated in FIGS. 2, 5 and 6, the neck and body of the instrument are designed and arranged with respect to one another such that one or more of the strings does not connect body 20 and neck 60 in the majority or all of the region between bridge plate 30 and back end 64 of neck 60. As illustrated in FIG. 6, the string orientation of the instrument can be such that the strings lie in a generally concave plane relative to the front face 66 of the neck 60, and also lie in a generally convex plane relative to the front face 22 of body 20; however, this is not required. The generally concave plane orientation of the strings on the neck, when used, can be similar to the standard orientation of strings positioned on standard string instruments (e.g., guitar, etc.); however, this is not required. As such, during the playing of instrument 10, the feel and orientation of the fingers of the player on the neck 60 of instrument 10 can be made to closely emulate the play on a standard string instrument, thereby facilitating the play of the string percussion instrument; however, this is not required. The convex orientation of the strings on the front face of the body, when used, can be an opposite string orientation on standard string instruments; however, this is not required. On standard string instruments, the strings are in a generally concave plane over both the neck and body of the string instrument. The convex orientation of the strings on the body of instrument 10 can enable a plurality or all of the strings to be simultaneously struck when using a standard drum stick or the like. This cannot be accomplished on standard string instruments due to the concave orientation of the strings.

As best illustrated in FIGS. 2 and 5, the front face 22 of body 20 faces opposite the front face 66 of neck 60. As such, the front faces of the body and the neck are rotated about 180° relative to one another. As can be appreciated, the front faces of the body and the neck can be rotated at other angles relative to one another (e.g., 90-180° relative to one another, 180-270° relative to one another, etc.). Generally, the relative angles of the front faces of the body and the neck remain constant along the longitudinal lengths of the body and neck; however, this is not required.

Figure 4:
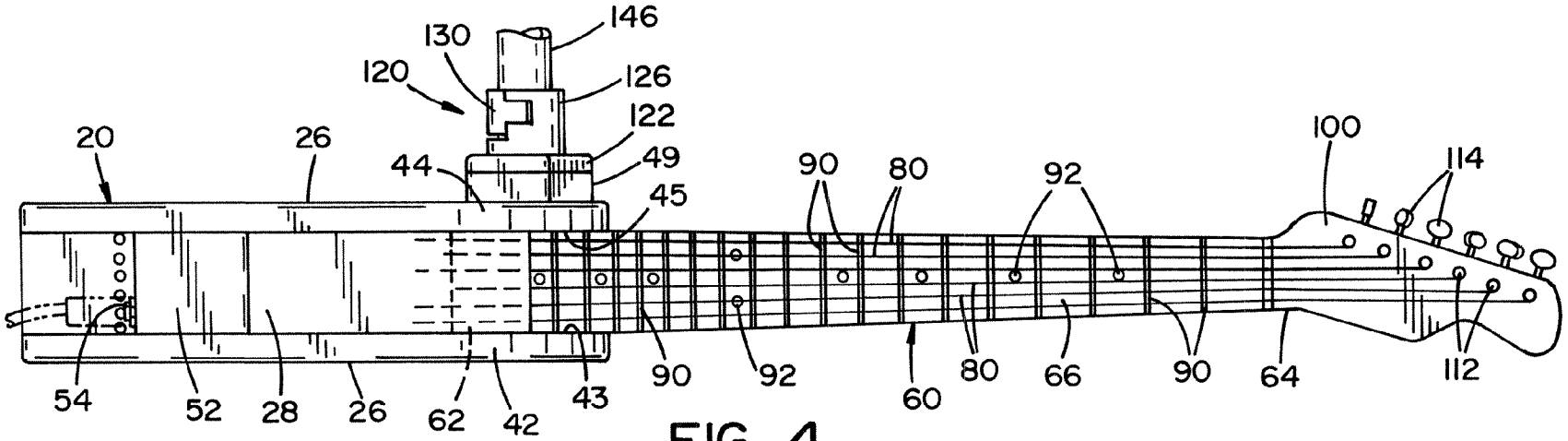
FIG. 4 is a bottom view of the string instrument of FIG. 1.

As best illustrated in FIGS. 2, 4 and 5, a plurality of strings 80 are positioned over the front face 66 of neck 60. The front face of neck 60 can include a fingerboard; however, this is not required. The fingerboard, when used, can be releasably or permanently secured to the neck in a variety of manners. The fingerboard, when use, can include one or more frets 90; however, this is not required. The fingerboard can also include one or more fret markers 92 or position markers along the length of the fingerboard; however, this is not required. The configuration of the neck, frets, and markers can be the same or similar to such arrangements used on various types of acoustic guitars, electric guitars, or other types of string instruments; however, this is not required. The materials used to the form the neck and/or frets, when used, are non-limiting. The shape, color and/or design of the neck is non-limiting.

Connected to back end 64 of neck 60 is a headstock 100; however, this is not required. The headstock can be permanently or releasably connected to the neck. The headstock, when used, can include one or more tuners; however, this is not required. The tuners, when used, are used to increase or decrease the tension on a particular string in order to tune a particular string. The configuration of the headstock and tuners can be the same or similar to such arrangements used on various types of acoustic guitars, electric guitars, or other types of string instruments; however, this is not required. Generally the headstock 100 includes several tuner openings, not shown, which are designed to receive pins 112 of tuners 110. Pins 112 of tuners 110 are designed to be each connected to a string 80. Pegs 114 on the tuners are designed to cause pins 112 to rotate, thereby increasing or decreasing the tension on a particular string in order to tune a particular string. The shape, color, material and/or design of the headstock and/or tuner, when used, are non-limiting.

Referring now to FIGS. 1-4 and 6, the body 20 if the instrument can include a mounting arrangement 120 that can be used to permanently or releasably connect the body of the instrument to a stand and/or other type of support structure; however, the inclusion of such mounting arrangement is not required. As can be appreciated, neck and/or head stock can additionally or alternatively include the mounting arrangement; however, this is not required. As illustrated in FIG. 1, the mounting arrangement is used to secure the body 20 of the instrument 10 to a stand 140. Stand 140 includes legs 142, a body 144 and an adjustable arm 146. The design, configuration, shape, materials and/or function of the stand are non-limiting. Stands similar to the one illustrated in FIG. 1 are well known in the art, thus the configuration and/or operation of the stand will not be further discussed.

The mounting arrangement 120 is illustrated as having a clamp body 122 that is secured to side wall 44 of body 20. The clamp body 122 can be secured to body 20 in a variety of ways (e.g., adhesive, clamp, screw, bolt, nail, etc.). As illustrated in FIG. 3, a plurality of screws 124 are used to secure the clamp body to side wall 44. Side wall 44 is illustrated as including an elevated mounting surface 49; however, such mounting surface is not required. The mounting arrangement includes tubing 126 that extends from clamp body 122. The tubing includes a cavity 128 that is designed to receive an end portion 148 of adjustable arm 146 of stand 140. The tubing 126 includes a pivoting portion 130 that pivots on a pin 132. The pivoting portion is adjustably positioned by use of a knob 134. The turning of the knob is used to clamp and/or unclamp the end portion 148 of stand 140 in cavity 128. As can be appreciated, mounting arrangement 120 can have many different arrangements that are used to secure the instruments to a stand or the like.

In operation as illustrated in FIG. 1, the instrument is mounted to a stand 140 to enable a player to strike with stick S one or more of the strings 80 on the front face 22 of body 20 while the front face is facing the player. While the one or more strings 80 on the front face 22 of the body are facing the player, the one or more strings on the neck 60 of the instrument face away from the player. This configuration of the instrument enables a player that is familiar with playing a string instrument (e.g., guitar, etc.) to position his/her fingers on the neck and strings to produce notes and chords similar to ones that could be formed when play a standard string instrument. The player can position his/her fingers on the strings on the neck with one hand and strike the strings facing the player on the body to create certain tones on the instrument. Since the configuration of the strings on the neck of instrument 10 can be the same or similar to standard string instruments, a player that is already able to play a standard string instrument can easily finger the strings on instrument 10 of the present invention to create the desired sounds from the instrument when the strings on the body are struck.

The present invention has been described with reference to a number of different embodiments. It is to be understood that the invention is not limited to the exact details of construction, operation, exact materials or embodiments shown and described, as obvious modifications and equivalents will be apparent to one skilled in the art. It is believed that many modifications and alterations to the embodiments disclosed will readily suggest themselves to those skilled in the art upon reading and understanding the detailed description of the invention. It is intended to include all such modifications and alterations insofar as they come within the scope of the present invention.

We claim:

1. An instrument having a body, a neck and a plurality of strings connected between the body and neck, said body having a front face, said neck having a front face, a plurality of said strings passing over said front face of said body and said front face of said neck, said front face of said neck being offset by at least 150° relative to a longitudinal axis of said strings from said front face of said body, said plurality of strings overlying at least a portion of said front face of said body and said neck, said body including a bridge plate and a cavity, said cavity spaced from said bridge plate, said cavity being positioned between said bridge plate and said neck, said neck connected to said cavity, said plurality of strings passing through said cavity as said plurality said strings transitions from said body to said neck, said plurality of strings passing through said cavity spaced from a plurality of inside walls of said cavity.

2. The instrument as defined in claim 1, wherein said body includes a plurality of intonation sliders, said intonation sliders connected to an end of at least one of said strings, said intonation sliders positioned on an opposite of said bridge plate from said cavity.

3. The instrument as defined in claim 2, wherein said cavity, said bridge structure, and combinations thereof includes an L-shaped configuration or a U-shaped configuration.

4. The instrument as defined in claim 3, wherein said body includes a mount connector designed to at least partially mount said body to a stand.

5. The instrument as defined in claim 4, including a head stock connected to said neck, said head stock including at least one tuner.

6. The instrument as defined in claim 5, wherein said body includes at least one electronic component, said electronic component including a component selected from the group consisting of volume control, tone control, special effect control, output jack, electrical connector, pickup, and combinations thereof.

7. The instrument as defined in claim 6, including a finger board on said front face of said neck.

8. The instrument as defined in claim 7, wherein said finger board includes at least one component selected from the group consisting of a fret, marker, position marker, and combinations thereof.

9. The instrument as defined in claim 8, wherein said at least one string is spaced from said body, a plurality of said inside walls of said cavity and said neck at a location between said bridge plate and an end of said neck.

10. The instrument as defined in claim 9, wherein all of said strings overlie a majority said front face of said body and a majority said front face said neck, said front face of said neck being offset by about 180° relative to said longitudinal axis of said strings.

11. The instrument as defined in claim 10, wherein a plurality of said strings lie in a generally concave plane over at least a majority of said neck and a plurality of said strings lie in a generally convex plane over a majority of said body.

12. The instrument as defined in claim 11, wherein said strings cannot be struck by a player in a region that said strings pass through said cavity.

* * * * *